US006352120B1

(12) United States Patent
Carbaugh

(10) Patent No.: US 6,352,120 B1
(45) Date of Patent: Mar. 5, 2002

(54) PACKER INSERT FOR SEALING ON MULTIPLE ITEMS IN THE WELLBORE

(75) Inventor: William L. Carbaugh, Humble, TX (US)

(73) Assignee: Hydril Company, Houston, TX (US)

( * ) Notice: Subject to any disclaimer, the term of this patent is extended or adjusted under 35 U.S.C. 154(b) by 0 days.

(21) Appl. No.: 09/496,867

(22) Filed: Feb. 2, 2000

Related U.S. Application Data

(60) Provisional application No. 60/119,007, filed on Feb. 8, 1999.

(51) Int. Cl.[7] ..... E21B 33/12

(52) U.S. Cl. ..... 166/387; 166/180; 166/195

(58) Field of Search ..... 166/337, 348, 166/387, 180, 135, 192, 195, 208, 217

(56) References Cited

U.S. PATENT DOCUMENTS

| | | | | |
|---|---|---|---|---|
| 3,791,442 A | * | 2/1974 | Watkins | 166/352 |
| 4,448,255 A | * | 5/1984 | Shaffer et al. | 166/387 |
| 4,832,126 A | * | 5/1989 | Roche | 166/358 |
| 5,273,108 A | | 12/1993 | Piper | 166/90 |

FOREIGN PATENT DOCUMENTS

| | | |
|---|---|---|
| EP | 0122708 A2 | 10/1984 |
| EP | 0242008 A2 | 10/1987 |
| GB | 2 013 759 A | 8/1979 |
| GB | 2 112 839 A | 7/1983 |
| GB | 2 125 469 A | 3/1984 |
| GB | 2246587 A | 2/1992 |
| WO | WO 99/01639 | 1/1999 |

OTHER PUBLICATIONS

Perry, et al., "Chemical Engineer's Handbook", 1963, McGraw–Hill Book Co., 4th edition, ch.23–p. 61.*

United Kingdom Search Report dated Apr. 30, 2001, 1 page.

European Patent Office Search Report, Jun. 22, 2000, 1 page.

* cited by examiner

*Primary Examiner*—David Bagnell
*Assistant Examiner*—Zakiya Walker
(74) *Attorney, Agent, or Firm*—Rosenthal & Osha L.L.P.

(57) ABSTRACT

A multiple item sealing packing insert for use with oil field service products in a wellbore has a first member comprising a composite material having an elastomer and a structural support material and a second member comprising a composite material having an elastomer and a structural support material. The first member and second member are configured to envelop items in the wellbore with the elastomer upon application of radial pressure.

16 Claims, 3 Drawing Sheets

PACKER INSERT FOR SEALING ON MULTIPLE ITEMS IN THE WELLBORE

This application claims the benefit of provisional application serial No. 60/119,007 filed on Feb. 8, 1999.

FIELD OF THE INVENTION

This invention relates to a device for sealing on multiple items in a wellbore, e.g., drillpipe with umbilical and/or control lines. More specifically, the invention relates to a multiple item sealing packer insert configured to envelop items within a wellbore upon the application of radial pressure.

BACKGROUND OF THE INVENTION

Currently, there is no effective way of effecting a seal on multiple lines in the wellbore using an annular blowout preventer ("BOP"), diverter, or similar oil field service product. Presently, in wellbore situations in which sealing on multiple lines is required, the annular BOP is closed around these items and leakage occurs at the interface between them. The leakage is produced by the pressure differential in which the higher pressure of the wellbore seeps through gaps between the items to reach the lower pressure outside the wellbore. The amount of leakage varies with wellbore pressure and the number, size, and geometry of the items in the wellbore.

The leakage described above is undesirable because it creates a hazard to both workers and the environment. If there are large gaps between items in the wellbore, the leakage may be substantial and, under high pressure, fluid flow could "jet" from the BOP and create a hazard on the rig floor. Moreover, the loss of drilling fluid makes it difficult to effectively control wellbore pressure.

The absence of complete control over wellbore pressure can produce dangerous side effects. For example, wells are typically "shut in" to prevent a blowout after a gas "kick" is detected within the wellbore. The kick is controlled by sealing the annulus of the wellbore and "circulating out" the gas in a controlled process. If gaps exist between multiple items in the wellbore, the pressure integrity of the closed in well could be lost or reduced. In this case, the well control scheme is less effective and fluid that escapes the wellbore under pressure could produce a hazard to workers.

The leakage of wellbore fluids between multiple items can also lead to environmental contamination. Oilfield service and exploration companies take precautions to prevent drilling fluid or "mud" from escaping the fluid circulation system at the rig site. Leakage of drilling mud can contaminate the ground around the BOP stack and, as previously mentioned, can contaminate the rig floor. This is a particular problem when oil-based or potentially corrosive muds are used in the drilling process.

Subsea operations present another difficulty. Environmental regulations prevent the uncontrolled release of drilling fluids into the surrounding subsea environment. The penalties for violating these measures are severe and costly cleanups may ensue.

Elastomer sleeves have been used around items in the wellbore such as umbilical or control lines in an attempt to solve the above problem. These sleeves were attached only to auxiliary lines. A problem of using this method is that locating the sleeves in the BOP, diverter, or similar oil field service product is difficult. The nature of BOP operation typically requires immediate action. Therefore, the sleeves would have to be aligned with the BOP at all times so that they would be in place for activation of the BOP.

SUMMARY OF THE INVENTION

The present invention provides a means of sealing on multiple items in the wellbore, e.g., a drillpipe with umbilical and control lines. The invention also has a positive locating feature.

In general, a multiple item sealing packing insert for use with oil field service products in a wellbore has a first member comprising a composite material having an elastomer and a structural support material and a second member comprising a composite material having an elastomer and a structural support material. The first member and second member are configured to envelop items in the wellbore with the elastomer upon application of radial pressure.

In accordance with one or more embodiments of the invention, the two members may be configured to fill an area between the items in the wellbore upon application of radial pressure. The structural support material may be a metal or a thermoplastic. The packing insert may either be a separate entity or an integral part of a blowout preventer, a diverter, or a similar structure.

DETAILED DESCRIPTION

Figure 1:
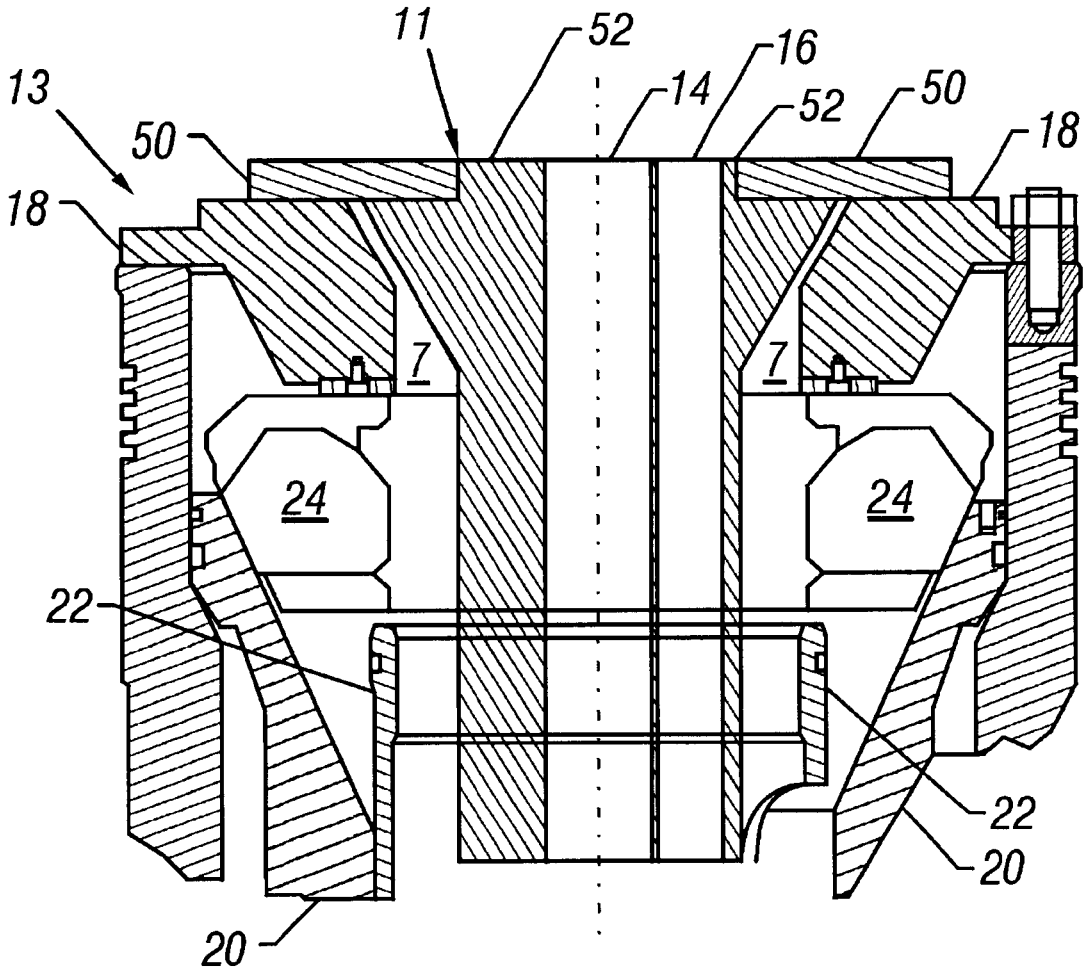
FIG. 1 shows a cross-sectional view of an embodiment of the present invention disposed within a diverter.

Referring to the drawings wherein like reference characters are used for like parts throughout the several views, FIG. 1 shows a cross sectional view of an embodiment of the present invention disposed within a diverter 13. In one embodiment, the invention has two members comprising a top plate attached to composite material consisting of an elastomer with structural support material. The structural support material may be, for example, a metal or thermoplastic material. These two members are configured to envelop the items in the wellbore with elastomer and to completely fill the gaps between the items. The two members may be attached to one another (not shown in the Figures) by any means known in the art, e.g., bolted together. It will also be understood by those skilled in the art that three or more members may alternatively be used in accordance with embodiments of the present invention.

The diverter 13 is well known by those in the art and thus will not be discussed in detail herein. As in a standard diverter, the diverter 13 has a housing cap 18, a piston 20, and a sleeve 22. Packer insert 11 comprises a top plate 50 attached to an elastomer body 52. The packer insert 11 may be attached to the diverter 13 (not shown in the Figures), e.g., top plate 50 may be bolted to housing cap 18. It can be seen that the packing insert 11 is positively located within the diverter 13. Positive location is due to top plate 50 extending diametrically beyond the interior of housing cap 18. Other means known in the art may be used to positively locate the packing insert within the diverter.

Packing unit 24 is disposed within the diverter 13 and when activated radially compresses elastomer body 52 of packer insert 11 about the multiple items within the wellbore. For example, activation of the device shown in FIG. 1 would radially compress elastomer body 52 about and in between drillpipe 14 and umbilical line 16. In FIG. 1, elastomer body 52 is shown to be separated from housing cap 18 by an area 7. In FIG. 1, area 7 comprises air space. This will be understood by those skilled in the art to be a matter of design choice. In alternative embodiments, elastomer body 52 may completely or partially fill the area 7 and may come into contact with housing cap 18. Moreover, area 7 may be filled or partially filled with another body.

Figure 2A:
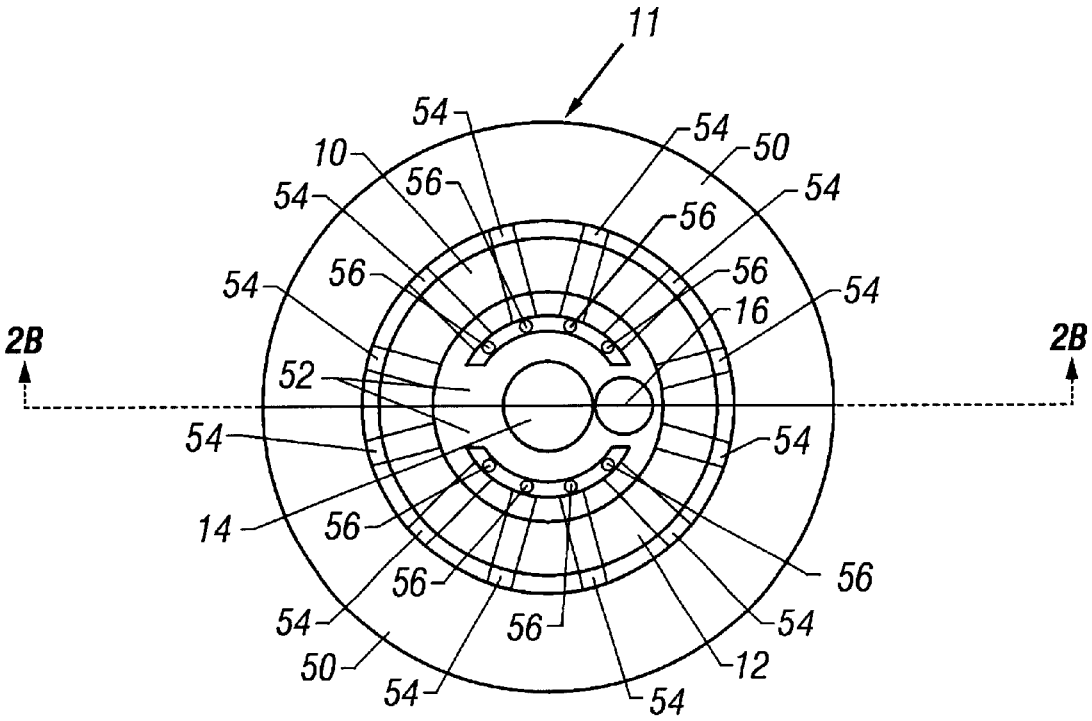
FIG. 2A shows a top view of the packing insert according to an embodiment of the present invention.

FIG. 2A shows a top view of packer insert 11. As can be seen, packer insert 11 is split into two members 10 and 12. Similar components on members 10 and 12 will be described with similar reference numbers. On each member 10 and 12, six attachment plates 54 extend from the top plate 50 into the elastomer body 52. Attachment plates 54 are shown equally spaced about the radial axis 13 of the packer insert 11, but one skilled in the art will appreciate that these may be otherwise configured. The four interior attachment plates each connect to an elastomer reinforcement member 56. These elastomer reinforcement members 56 are connected together by a stiffener 58 and will be further described with reference to FIGS. 3A and 3B below.

Figure 2B:
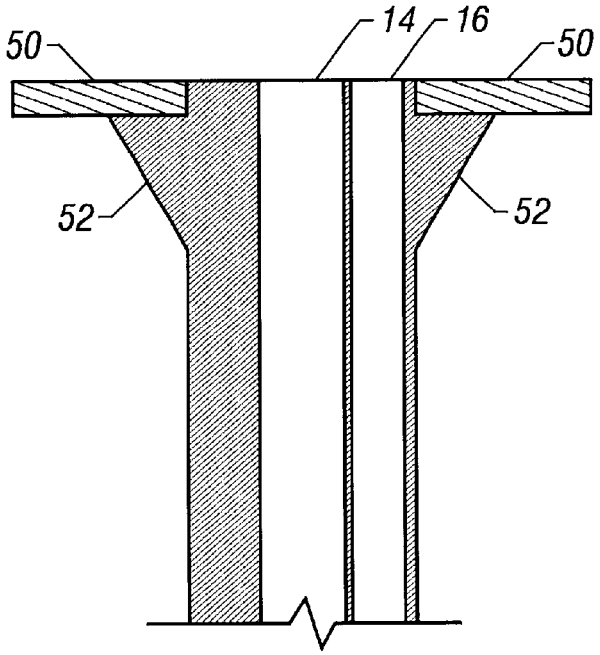
FIG. 2B shows a cross-sectional view along section line A—A of the packing insert according to an embodiment of the present invention.

FIG. 2B shows a cross sectional view of packer insert 11 along section line A—A. The positional relationship of the drillpipe 14 and the umbilical line 16 within elastomer body 52 is evident.

Figure 3A:
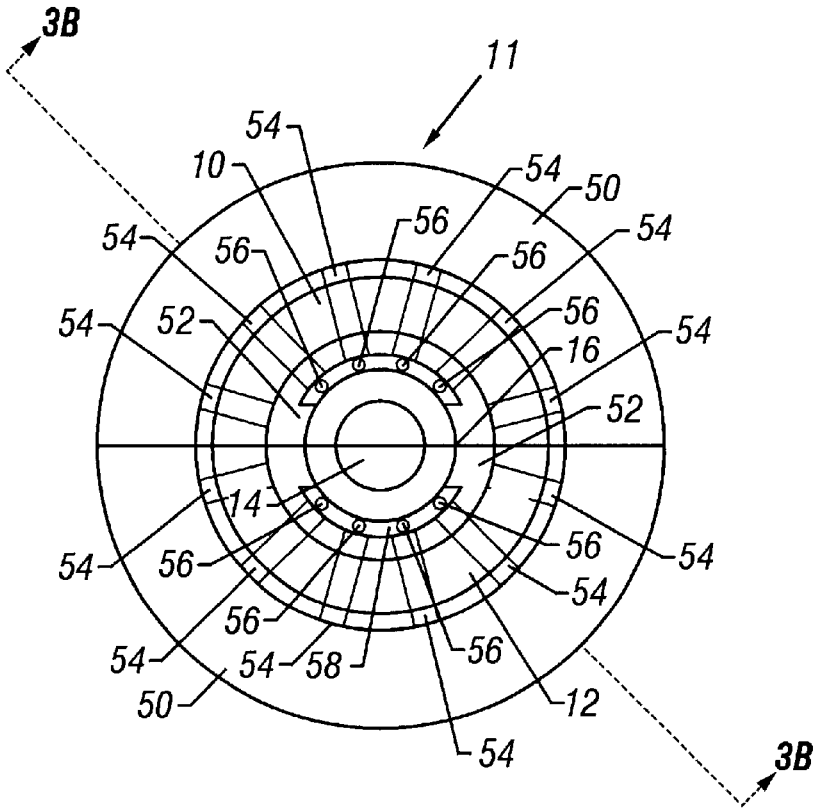
FIG. 3A shows a top view of the packing insert according to an embodiment of the present invention.
Figure 3B:
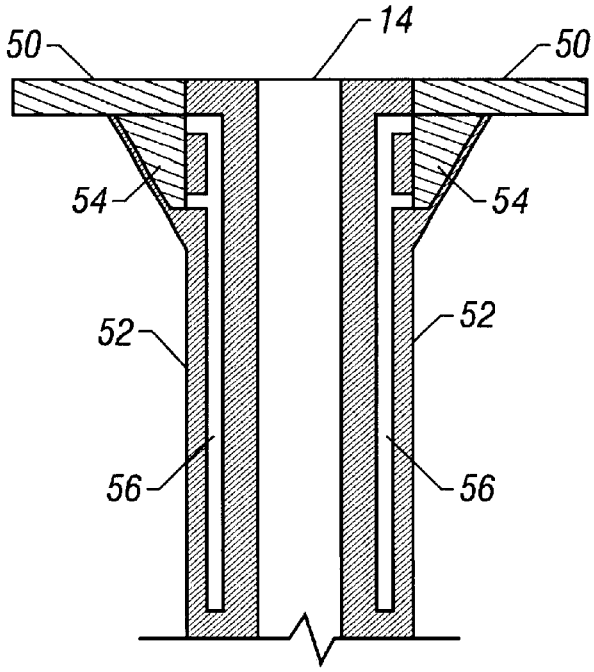
FIG. 3B shows a cross-sectional view along section line B—B of the packing insert according to an embodiment of the present invention.

FIG. 3A is a top view of packer insert 11 similar to FIG. 2A. FIG. 3B is a cross-sectional view along section line B—B shown in FIG. 3A. Referring to FIG. 3B, elastomer reinforcement members 56 are enveloped by the elastomer body 52. Attachment plates 54 provide a foundation for the elastomer reinforcement members 56. As can be seen, the attachment plates 54 are angled extensions from top 50. However, one skilled in the art will recognize that the attachment plates could be made separately from the top plate and then attached thereto. Elastomer reinforcement members 56 are attached to attachment plates 54 in a configuration that allows the longitudinally extending portion of the member to be completely enveloped by the elastomer body 52. Elastomer reinforcement members 56 may be made, for example, of a metal or thermoplastic material and provide structural support. One skilled in the art will recognize that other structural support materials may be used.

One skilled in the art will recognize that the individual elastomer reinforcement bodies 56 and the individual attachment plates 54 may be constructed as unitary bodies. Moreover, the top plate 50, the elastomer reinforcement bodies 56, and the attachment plates may be constructed as a unitary body or as a unitary body that is then separated into first and second members. The elastomer body 52 may then be formed around the other elements to complete the packer insert 11.

The present invention has several distinct advantages. In one aspect, the invention enables the packing unit to seal around multiple lines in the wellbore without leakage. The invention is positively located within the oil field service product and ensures proper positioning and alignment. Proper positioning and alignment ensures that the BOP may be operated at any time without having to move the items in the wellbore into a special position.

Another advantage of the invention is that it may be incorporated into the design of an existing BOP. In one embodiment, the invention may be present within the BOP as a standard fixture. In one embodiment, the invention may be manufactured as a separate entity and used in conjunction with standard oil field service products. This flexibility of manufacture permits the retrofit of existing BOPs already in use by service and exploration companies. Further, a considerable economic advantage exists due to the ability to retrofit rather than purchase a new BOP. Moreover, the replacement of worn packer inserts may be easily accomplished.

Another advantage of the invention is that the compression of the elastomer body about and in between the drillpipe and additional items in the wellbore maintains the integrity of the wellbore. A BOP can operate with multiple items in the wellbore and still provide a safe and effective annular sealing apparatus. This means that the well may be shut in without the concern of leakage flow presenting a hazard to operations.

While the present invention has been described with respect to a limited number of preferred embodiments, those skilled in the art will appreciate numerous modifications and variations therefrom. The appended claims are intended to cover all such modifications and variations which occur to one of ordinary skill in the art.

What is claimed is:

1. A packing insert for forming a seal around a plurality of items in a wellbore simultaneously comprising:

a top plate;

a plurality of attachment plates adjacent to the top plate and arranged radially about a center axis that is parallel to a wellbore axis, wherein each attachment plate is connected to the top plate;

a plurality of reinforcement members arranged radially about the center axis, wherein each reinforcement member is attached to at least one of the top plate and the attachment plates; and a body adjacent to and surrounding the attachment plates and the reinforcement members, the body comprising a solid structure with a bore therethrough, wherein the body fills an area around and between multiple items in the wellbore upon application of radial pressure.

2. The packing insert of claim 1 wherein the body is an elastomer.

3. The packing insert of claim 1 wherein the top plate comprises a first and a second member that are removably attached to each other.

4. The packing insert of claim 1 wherein the reinforcement members are attached to the top plate.

5. The packing insert of claim 1 wherein the reinforcement members are attached to the attachment plates.

6. The packing insert of claim 5 wherein each attachment plate and each reinforcement member comprise unitary bodies.

7. The packing insert of claim 1 wherein the attachment plates are formed separately from and are fixedly attached to the top plate.

8. The packing insert of claim 1 wherein the top plate, the attachment plates, and the reinforcement members comprise a unitary body.

9. The packing insert of claim 1 wherein the reinforcement members comprise metal.

10. The packing insert of claim 1 wherein the reinforcement members comprise thermoplastic.

11. The packing insert of claim 1 wherein the insert is removably attached to a blowout preventer.

12. The packing insert of claim 1 wherein the packing insert is an integral part of a blowout preventer.

13. A method for forming a seal around multiple items in a wellbore with a packing insert comprising:

exerting a radial force on a packing insert; and deforming a body and reinforcement members such that a seal is formed around a plurality of items in a wellbore simultaneously;

wherein the packing insert comprises a top plate; a plurality of attachment plates adjacent to the top plate and arranged radially about a center axis that is parallel to a wellbore axis, wherein each attachment plate is connected to the top plate; a plurality of reinforcement members arranged radially about said center axis, wherein each reinforcement member is attached to at least one of the top plate and the attachment plates; and a body adjacent to and surrounding the attachment plates and said reinforcement members;

and wherein the body -comprises a solid structure with a bore therethrough.

14. The method of claim 13 wherein the radial force is exerted by activating an annular blowout preventer.

15. A packing insert for forming a seal around multiple items in a wellbore comprising:

a top plate;

a plurality of attachment plates adjacent to the top plate and arranged radially about a center axis that is parallel to a wellbore axis, wherein each attachment plate is connected to the top plate;

a plurality of reinforcement members arranged radially about said center axis, wherein each reinforcement member is attached to at least one of the top plate and the attachment plates;

a body adjacent to and surrounding said attachment plates and said reinforcement members, the body comprising a solid structure with a bore therethrough, wherein the body fills an area around and between multiple items in the wellbore upon application of radial pressure;

means for exerting a radial force on the packing insert; and means for deforming the body and the reinforcement members such that a seal is formed around a plurality of items in the wellbore simultaneously.

16. A packing insert for forming a seal with multiple items in a wellbore, the insert comprising a plurality of sections, each section comprising:

a top plate;

at least one attachment plate adjacent to the top plate and arranged radially about a center axis that is parallel to a wellbore axis, wherein each attachment plate is connected to the top plate;

at least one reinforcement member arranged radially about the center axis, wherein each reinforcement member is attached to at least one of the top plate and the attachment plate; and a body adjacent to and surrounding said at least one attachment plate and said at least one reinforcement member;

wherein the packing insert comprises a solid structure with a bore therethrough, wherein the packing insert fills an area around and between multiple items in the wellbore upon application of radial pressure, and wherein each of the sections is adjacent to at least one other section and the sections are arranged radially about the center axis.

* * * * *